US005272504A

United States Patent [19]

Omura et al.

[11] Patent Number: 5,272,504

[45] Date of Patent: Dec. 21, 1993

[54] DEVICE FOR ERASING RESIDUAL CHARGE ON PHOTOSENSITIVE MEMBER

[75] Inventors: Kunihiko Omura, Toyokawa; Hitoshi Saito, Machida; Toshihiko Kumon, Aichi, all of Japan

[73] Assignee: Minolta Camera Kabushiki Kaisha, Osaka, Japan

[21] Appl. No.: 785,453

[22] Filed: Oct. 31, 1991

[30] Foreign Application Priority Data

Nov. 7, 1990 [JP] Japan ..... 2-303248
Dec. 21, 1990 [JP] Japan ..... 2-404979
Dec. 21, 1990 [JP] Japan ..... 2-404980

[51] Int. Cl.[5] ..... G03G 15/02
[52] U.S. Cl. ..... 355/218; 355/219; 361/212
[58] Field of Search ..... 355/218, 219; 361/212

[56] References Cited

U.S. PATENT DOCUMENTS 4,035,750 7/1977 Staudenmayer et al. ..... 355/200
4,538,900 9/1985 Lutus et al. ..... 355/210 X
4,607,934 8/1986 Kohyama et al. ..... 355/210
4,645,330 2/1987 Kohyama et al. ..... 355/229
4,827,306 5/1989 Tsujimoto et al. ..... 355/210 X

FOREIGN PATENT DOCUMENTS 63-221378 9/1988 Japan .
63-240167 10/1988 Japan .

*Primary Examiner*—A. T. Grimley
*Assistant Examiner*—Nestor R. Ramirez
*Attorney, Agent, or Firm*—Willian Brinks Olds Hofer Gilson & Lione

[57] ABSTRACT

An erasing device for erasing charge remaining on a photosensitive member, comprising: two kinds of light sources which are so provided as to confront the photosensitive member and have different light emitting wavelengths, respectively; and a control device for turning on the light sources simultaneously.

12 Claims, 16 Drawing Sheets

DEVICE FOR ERASING RESIDUAL CHARGE ON PHOTOSENSITIVE MEMBER

BACKGROUND OF THE INVENTION

The present invention generally relates to erasing devices for erasing charge remaining on a photosensitive member of a copying apparatus, a laser printer or the like.

Conventionally, in image forming apparatuses of a type in which corona charging, image exposure and development are performed on a photosensitive member so as to form a toner image on the photosensitive member such that the toner image is transferred onto a paper sheet, for example, a copying apparatus, a printer, etc., various erasing devices are employed so as to erase charge remaining on the photosensitive member after transfer of the toner image. For example, a tungsten lamp is used as a light source or a monochromatic light emitting diode is used as a light source.

Meanwhile, since a number of defects are present in a photosensitive layer of the photosensitive member, carrier is trapped in the defects and thus, it is impossible to completely erase residual charge. Hence, even after charge erasing, the photosensitive member has slight potential. Namely, when light is irradiated over the photosensitive member to which charge of negative polarity is imparted by a corona charger, holes and electrons are generated in the photosensitive layer at an irradiated portion of the photosensitive member and the holes are displaced towards a surface of the photosensitive member so as to cancel negative charge on the surface of the photosensitive member. On the other hand, the electrons are displaced towards a grounded substrate. At this time, a portion of the moving holes are trapped in the defects during travel of the holes and thus, surface potential of the photosensitive member does not drop completely, thereby resulting in residual potential.

Therefore, such problems arise that residual potential referred to above rises gradually through repetition of corona charging and exposure and charge erasing effect varies according to especially, environmental conditions such as temperature and humidity, thus adversely affecting an image. Variations of charge erasing effect due to change of environmental conditions is conspicuous in the case of an organic photosensitive member.

SUMMARY OF THE INVENTION

Accordingly, an essential object of the present invention is to provide an erasing device which is capable of restraining, even in high-temperature and high-humidity environment, rise of residual potential on a photosensitive member after charge erasing.

In order to accomplish this object of the present invention, an erasing device for erasing charge remaining on a photosensitive member, embodying the present invention comprises: two kinds of light sources which are so provided as to confront the photosensitive member and have different light emitting wavelengths, respectively; and a control means for turning on the light sources simultaneously.

Namely, in the present invention, since the two light sources having the different light emitting wavelengths are simultaneously turned on by the control means. Therefore, rise of residual potential on the photosensitive member is restrained by synergistic effect of light emitted from the respective light sources. For example, in the case where only light having a peak wavelength of about 600–800 nm is employed, residual potential rises in high-temperature and high-humidity environment. However, when this light is combined with light having a peak wavelength of about 400–600 nm, rise of residual potential can be restrained. Meanwhile, optimum kinds, irradiances, etc. of the light sources to be combined are selected in accordance with characteristics of the photosensitive member in use.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
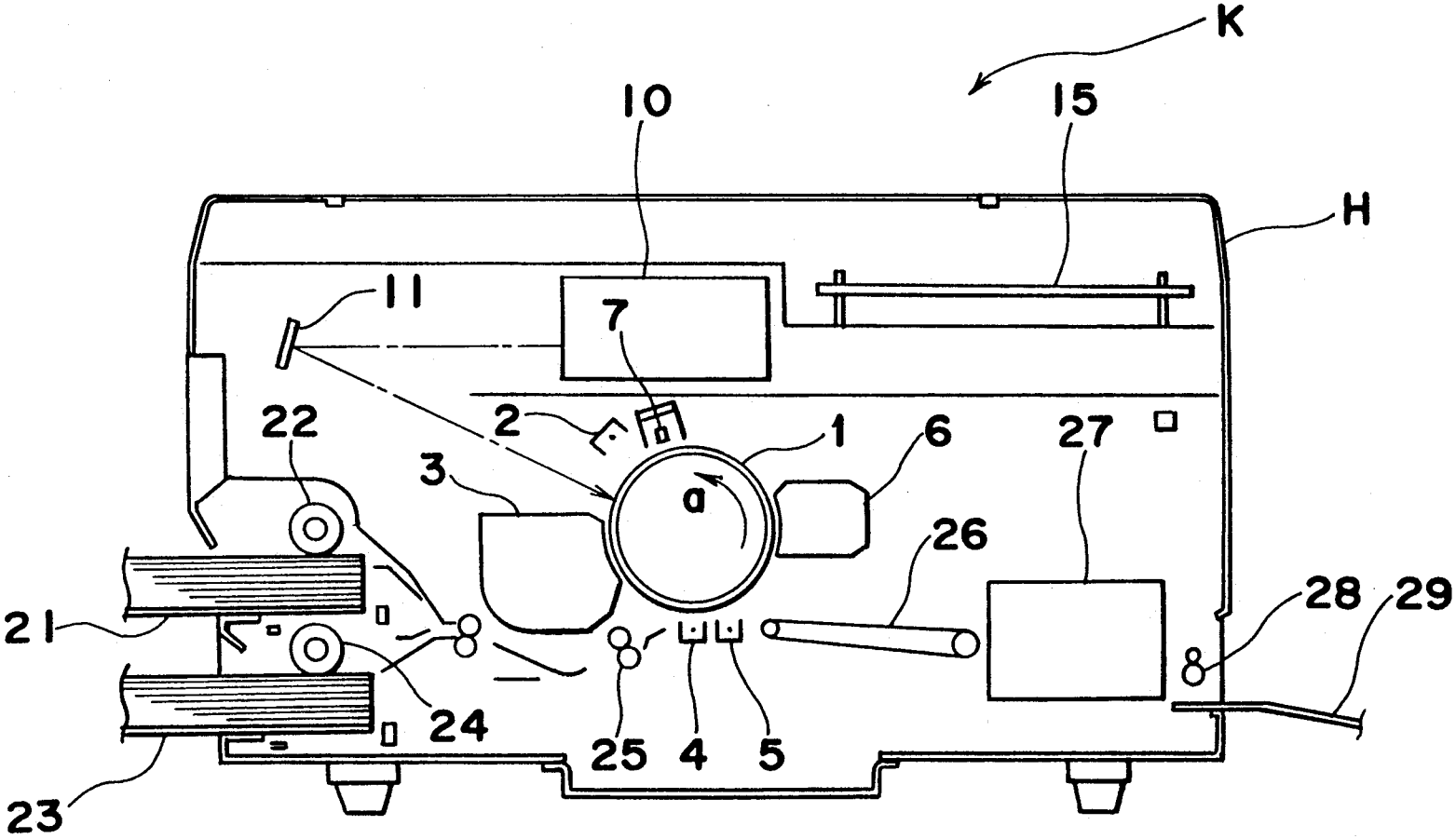
FIG. 1 is a schematic sectional view of a laser printer in which an erasing device for erasing residual charge on a photosensitive member, according to a first embodiment of the present invention is incorporated.

Referring now to the drawings, there is shown in FIGS. 1 to 4, a laser printer K to which an erasing device 7 for erasing residual charge on a photosensitive drum 1, according to a first embodiment of the present invention is applied. As shown in FIG. 1, the photosensitive drum 1 is rotatably provided at a central portion of a printer housing H so as to be rotated in the direction of the arrow a. A corona charger 2, a magnetic brush type developing device 3, a transfer charger 4, a charge eraser 5, a cleaning device 6 for cleaning residual toner on the photosensitive drum 1 and the erasing device 7 are provided around the photosensitive drum 1 sequentially in this order. Meanwhile, at an upper portion of the printer housing H, a laser optical system 10 and a control unit 15 for controlling the laser optical system 10 are provided. The laser optical system 10 incorporates a laser light emitting element, a polygon mirror, an fθ optical element, etc. and scans the photosensitive drum 1 in its axial direction by a laser beam modulated based on image information. The laser beam radiated from the laser optical system 10 is reflected by a mirror 11 so as to be irradiated over the photosensitive drum 1 which is charged to a predetermined potential Vo by the corona charger 2. As a result, a negative electrostatic latent image is is formed on a surface of the photosensitive drum 1. This electrostatic latent image is developed into a toner image by the next developing device 3.

On the other hand, copy paper sheets are stored in automatic paper feeding units 21 and 23 so as to be fed one sheet by one sheet in the rightward direction in FIG. 1 upon rotation of paper feeding rollers 22 and 24, respectively. Then, the copy paper sheet is transported to a transfer section by a pair of timing rollers 25 synchronously with the toner image formed on the photosensitive drum 1. At the transfer section, the toner image is transferred onto the copy paper sheet through discharge from the transfer charger 4. Then, the copy paper sheet is immediately subjected to charge erasing by AC discharge from the charge eraser 5 so as to be separated from the photosensitive drum 1. Subsequently, the copy paper sheet is carried by a transport belt 26 to a fixing device 27 in which the toner image is fixed on the copying paper sheet. Thereafter, the copy paper sheet is discharged onto a copy receiving tray 29 by outlet rollers 28.

After the toner image has been transferred onto the copy paper sheet, rotation of the photosensitive drum 1 in the direction of the arrow a still continues. Thus, not only residual toner is removed from the surface of the photosensitive drum 1 by the cleaning device 6 but residual charge on the photosensitive drum 1 is erased by light irradiated from the erasing device 7.

Figure 9:
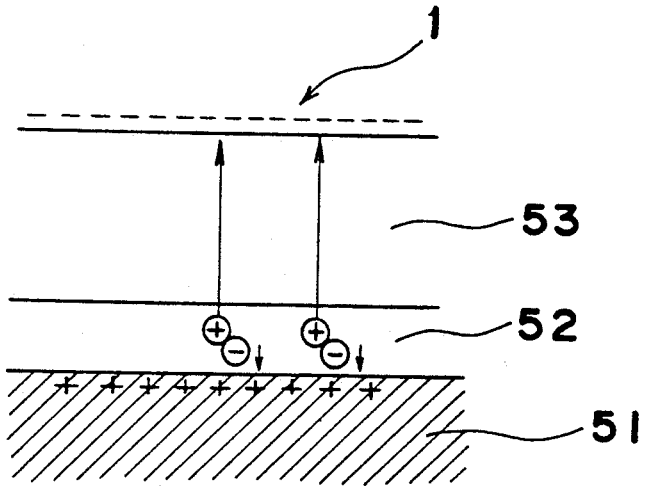
FIG. 9 is a schematic sectional view of an organic photosensitive surface layer of the photosensitive member of FIG. 1.

Meanwhile, in this first embodiment, the photosensitive drum 1 has an organic photosensitive surface layer. As shown in FIG. 9, the organic photosensitive surface layer includes a charge generating layer 52 and a charge transporting layer 53, which are formed on a cylindrical and electrically conductive substrate 51. The charge generating layer 52 is produced as follows. Namely, 0.45 part by weight of titanyl phthalolocyanine and 0.45 part by weight of polyvinyl butyral resin having a degree of acetylation of not more than 3 mol %, a degree of butylation of 68 mol % and a degree of polymerization of 1,500 are dispersed together with 100 parts by weight of cyclohexanone by using a sand grinder. Then, this solution is coated on an anodized aluminum drum to a thickness of 0.3 μm, whereby the charge generating layer 52 is obtained.

The charge transporting layer 53 is produced as follows. Namely, 10 parts by weight of hydrazone compound expressed by the following chemical formula and 10 parts by weight of polycarbonate resin K-1300 (brand name of Teijin Kasei Co., Ltd. of Japan) are dissolved in 160 parts by weight of solvent obtained by mixing dioxane and cyclohexanone at a ratio of 7 to 3.

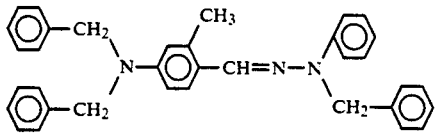

Then, this solution is coated on the charge generating layer 52 and dried to a thickness of 18 μm, whereby the charge transporting layer 53 is obtained.

Figure 2:
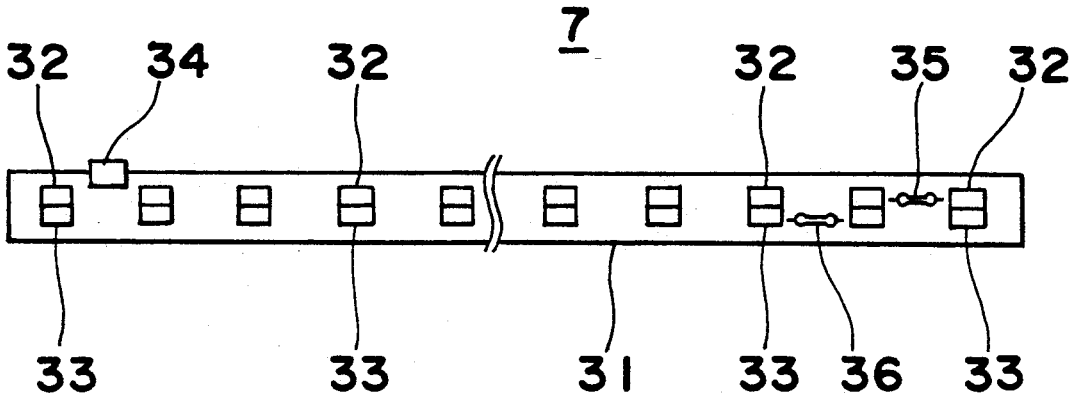
FIG. 2 is a top plan view of a light emitting surface of the erasing device of FIG. 1.
Figure 11:
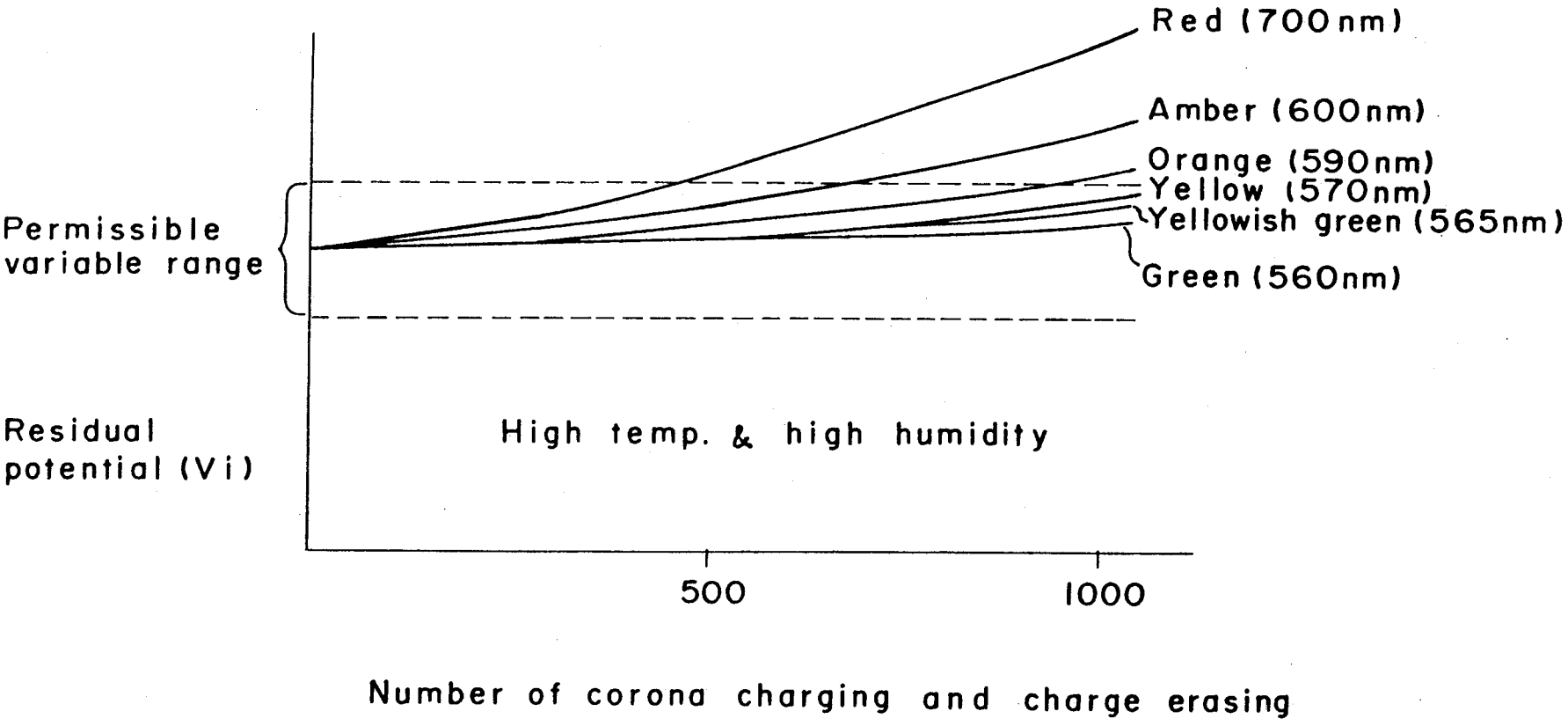
FIG. 11 is a graph showing change of residual potential of the photosensitive member of FIG. 1 subjected to repeated corona charging and charge erasing of various wavelengths.

The thus obtained organic photosensitive surface layer exhibits high sensitivity for light having a wavelength of 600-800 nm. Hence, a laser beam used for image exposure has a peak wavelength of 780 nm. Meanwhile, as shown in FIG. 2, the erasing device 7 includes a plurality of, for example, 10 red light emitting diodes 32 and a plurality of, for example, 10 green light emitting diodes 33 which are arranged side by side on a long holder 31. Red and green are selected as colors of the light emitting diodes 32 and 33 on the following ground. Namely, since the organic photosensitive surface layer exhibits high sensitivity for light having a wavelength of 600-800 nm as described above, light emitting diodes having a peak wavelength in the range of 600 to 800 nm are suitable and therefore the red light emitting diodes 32 having a peak wavelength of 660 nm are employed. Meanwhile, as shown in FIG. 11, since experiments on charge erasing at various wavelengths in high-temperature and high-humidity environment have revealed that rise of residual potential is gentler in the case of charge erasing performed by light emitting diodes having peak wavelengths in the range 500 to 600 nm, the green light emitting diodes 33 having a peak wavelength of 560 nm are used.

Figure 3:
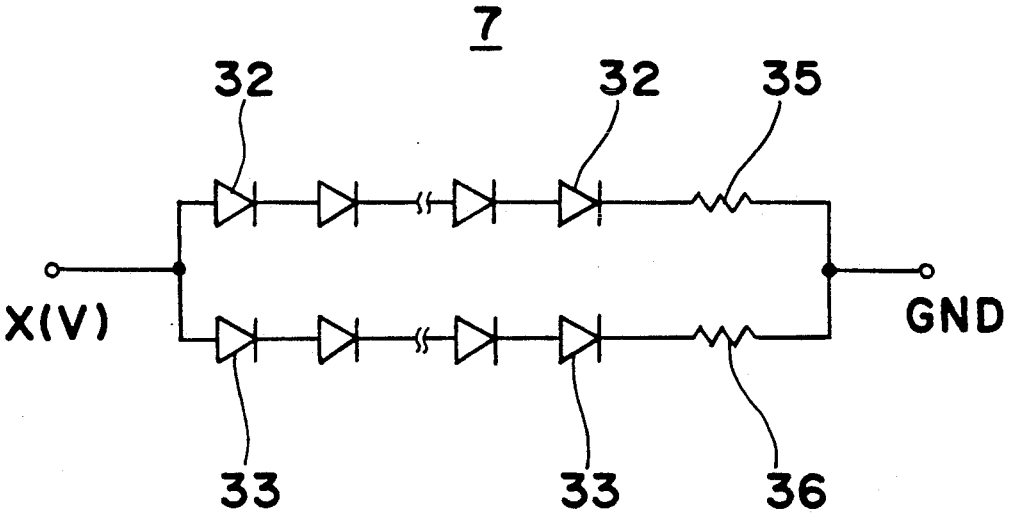
FIG. 3 is a circuit diagram of the erasing device of FIG. 1.

The holder 31 is provided with a connector 34 and resistors 35 and 36 for restricting electric current. The number and an interval of the light emitting diodes 32 or 33 are determined based on an axial length of the photosensitive drum 1 or quantity of light required for erasing residual charge. FIG. 3 shows an electric circuit of the erasing device 7. The light emitting diodes 32 are connected to each other in series and the light emitting diodes 33 are also connected to each other in series. On the other hand, the light emitting diodes 32 are connected to the light emitting diodes 33 in parallel.

Figure 4:
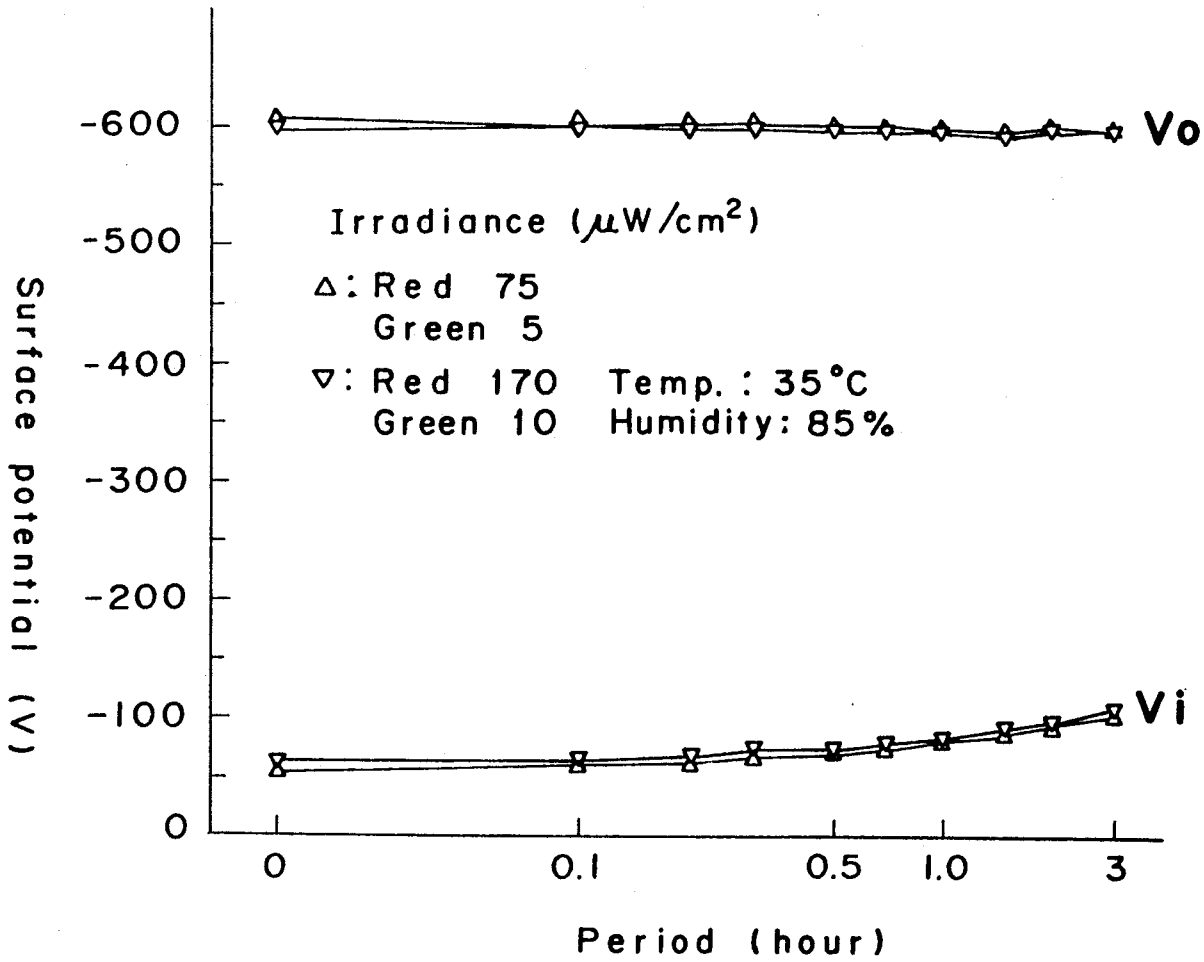
FIG. 4 is a graph showing change of surface potential of the photosensitive member of FIG. 1 subjected to corona charging and charge erasing repeatedly for a long time by the erasing device of FIG. 1.

Experiments on charge erasing of the photosensitive drum 1, in which the light emitting diodes 32 and 33 are simultaneously turned on by using the erasing device 7 of the above described arrangement, produced results shown in a graph of FIG. 4. In the experiments, the 10 red light emitting diodes 32 having a peak wavelength of 660 nm and the 10 green light emitting diodes 33 having a peak wavelength of 560 nm are employed. In a first example depicted by symbol "Δ", the red light emitting diodes 32 have an irradiance of 75 $\mu W/cm^2$, while the green light emitting diodes 33 have an irradiance of 5 $\mu W/cm^2$. Meanwhile, in a second example depicted by symbol "∇", the red light emitting diodes 32 have an irradiance of 170 $\mu W/cm^2$, while the green light emitting diodes 33 have an irradiance of 10 $\mu W/cm^2$. Environmental conditions include a temperature of 30° C., a humidity of 85% and a charging potential Vo of −600 V on the organic photosensitive surface layer. Residual potential Vi, which is obtained upon repetition of corona charging and charge erasing for 3 hr., rises by 45 V and 47 V in the first and second examples, respectively.

Figure 10:
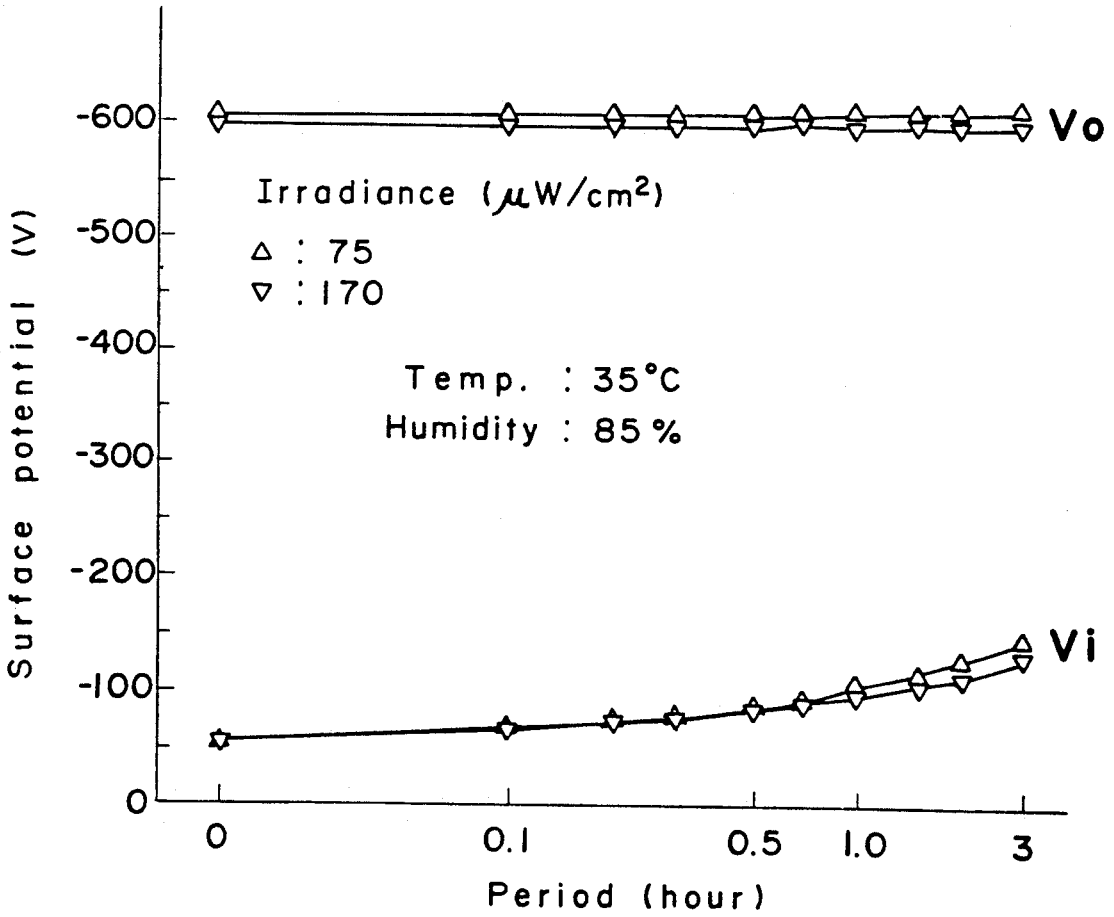
Fig. 10 PRIOR ART
FIG. 10 is a graph showing change of surface potential of a photosensitive member subjected to corona charging and charge erasing repeatedly for a long time by a prior art erasing device.

In order to confirm effects of the present invention, comparative experiments are performed on the same conditions as the above experiments by using 10 red light emitting diodes only and results of the experiments are shown in FIG. 10. Namely, in the experiments of FIG. 10, the charging potential Vo of −600 V is imparted to the organic photosensitive surface layer under such environmental conditions as a temperature of 30° C. and a humidity of 85% and charge erasing is performed at an irradiance of 75 $\mu W/cm^2$ (Δ) or 170 $\mu W/cm^2$ (∇) by using the red light emitting diodes having a peak wavelength of 660 nm. After repetition of corona charging and charge erasing for 3 hr., the residual potential Vi is obtained as shown in FIG. 10. As is seen from FIG. 10, the residual potential Vi under the high-temperature and high-humidity environmental conditions rises by 91 V in the case of the irradiance of 75 $\mu W/cm^2$ (Δ) and 74 V in the case of the irradiance of 170 $\mu W/cm^2$ (∇).

In the experiments of the present invention shown in FIG. 4, rise of the residual potential Vi is restricted rather lower than that of the comparative experiments of FIG. 10. This is probably because holes trapped in the charge transporting layer 53 of the organic photosensitive surface layer are released from trap by light from the green light emitting diodes 33 having a peak wavelength of 560 nm so as to cancel charge of negative polarity on the surface of the charge transporting layer 53. In the experiments of FIG. 4, an upper limit of irradiance of the green light emitting diodes 33 is set at 10 $\mu W/cm^2$. However, if irradiance of the green light emitting diodes 33 is raised further, rise of the residual potential Vi can be restricted more. Meanwhile, charge erasing by using only the green light emitting diodes 33 is improper on the grounds that the organic photosensitive surface layer has low sensitivity to green color and that it is at present difficult to obtain a large quantity of light by the green light emitting diodes.

Figure 5:
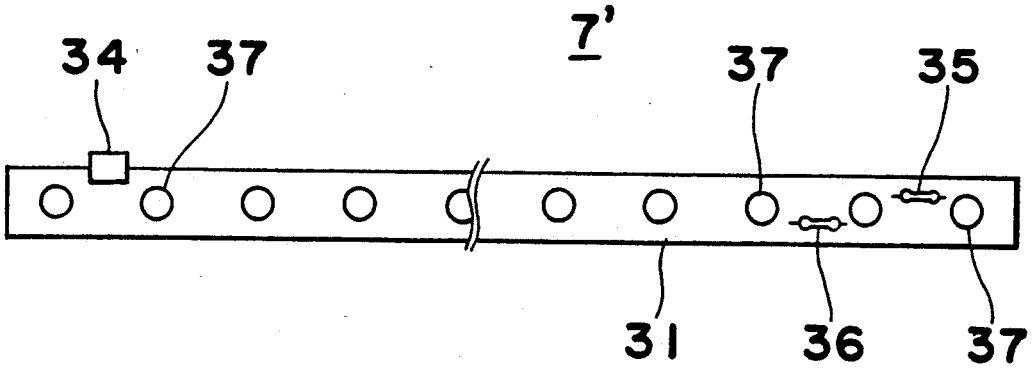
FIG. 5 is a top plan view of a light emitting surface of an erasing device which is a modification of the erasing device of FIG. 1.
Figure 6:
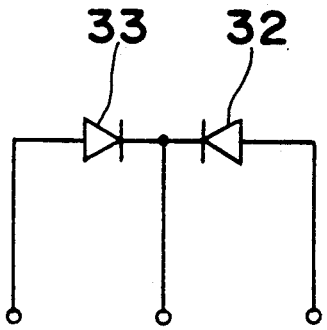
FIGS. 6 and 7 are circuit diagrams showing connection methods of light emitting diodes employable in the erasing device of FIG. 5, respectively.
Figure 7:
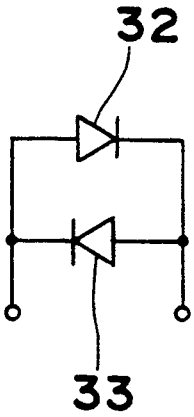
Figure 8:
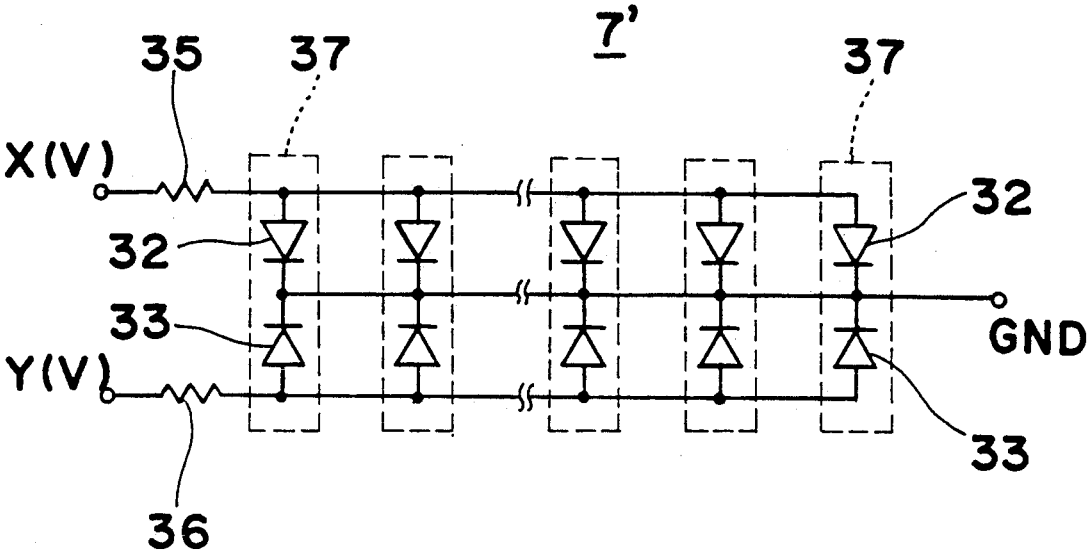
FIG. 8 is a circuit diagram showing unitary elements based on the connection method of FIG. 6.

Hereinbelow, an erasing device 7' which is a modification of the erasing device 7 is described with reference to FIGS. 5 to 8. As shown in FIG. 5, a plurality of two-color light emitting type elements 37 each having a circular light emitting face are provided together with a connector 34 and resistors 35 and 36 on the holder 31. In the element 37, the red light emitting diode 32 and the green light emitting diode 33 are electrically connected to each other as shown in either FIG. 6 or FIG. 7. FIG. 8 shows an electric circuit of a unitary erasing device employing connection of FIG. 6.

In the modified erasing device 7', function and effects are the same as those of the erasing device 7 according to the first embodiment of the present invention. Moreover, by accommodating a plurality of the light emitting sources in one element, the modified erasing device 7' is made more compact in size than the erasing device 7 according to the first embodiment of the present invention.

Meanwhile, in the present invention, the erasing device for erasing residual charge on the photosensitive member is not restricted to those of the first embodiment and its modification and can be modified variously in the scope of the present invention. For example, although the organic photosensitive surface layer is employed in the first embodiment and its modification, the present invention can also be likewise applied to an inorganic photosensitive surface layer. Meanwhile, although the light emitting diodes are employed as a light source in the first embodiment and its modification, an ordinary light source can also be used in the present invention by utilizing an optical fiber. Furthermore, optimum values of wavelengths and irradiances of the red and green light emitting diodes 32 and 33 can be selected in accordance with characteristics of the photosensitive member and light rays having other wavelengths than those of red light and green light may be combined with each other.

As is clear from the foregoing description, residual charge on the photosensitive member is erased by simultaneously turning on at least two kinds of the light sources having different wavelengths in the present invention. Therefore, in accordance with the present invention, rise of the residual potential in high-temperature and high-humidity environmental conditions, whose restriction has been impossible so far, can be minimized and thus, a high-quality image can be obtained.

Figure 12:
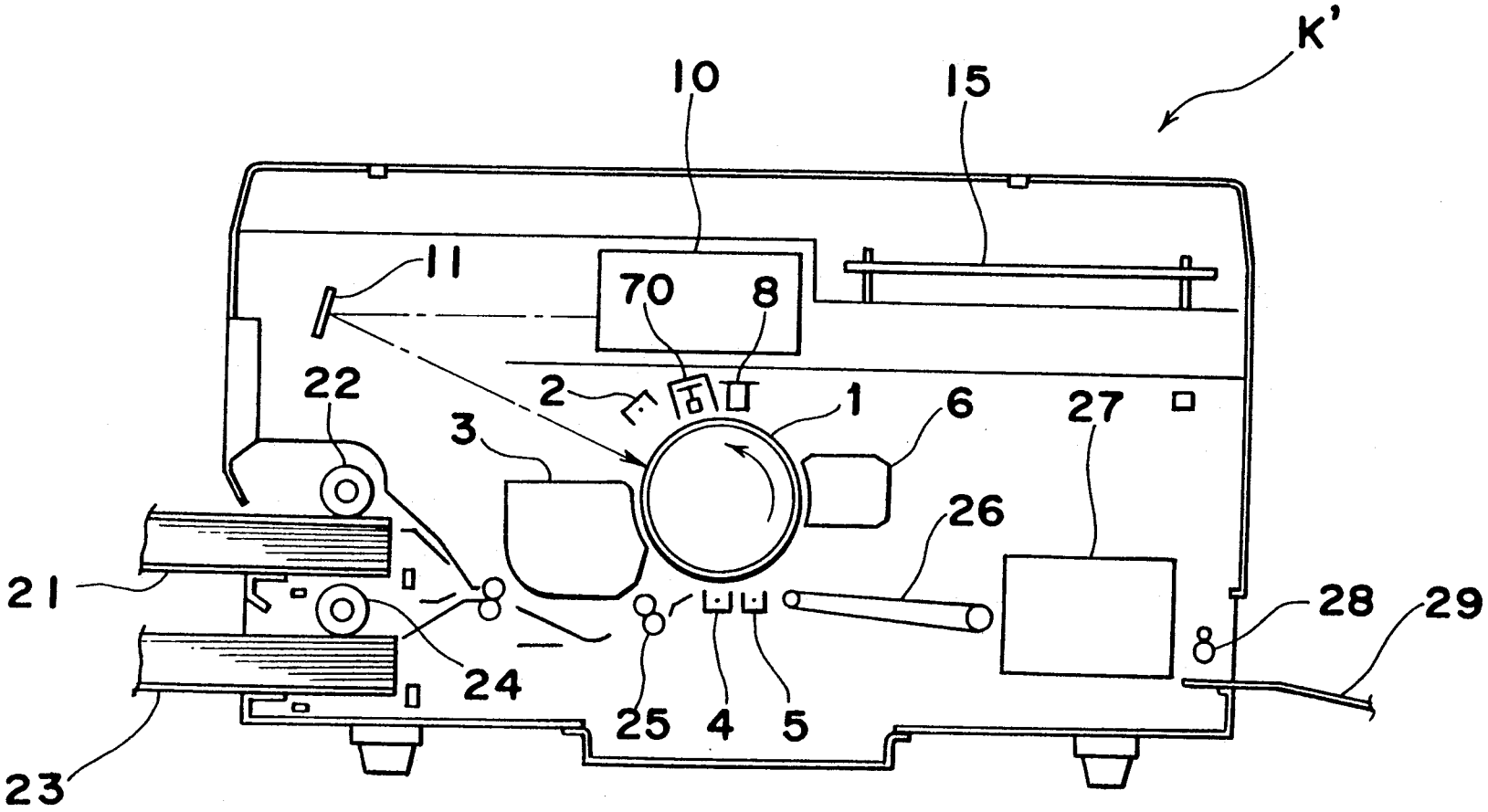
FIG. 12 is a schematic sectional view of a laser printer in which an erasing device for erasing residual charge on a photosensitive member, according to a second embodiment of the present invention is incorporated.
Figure 13:
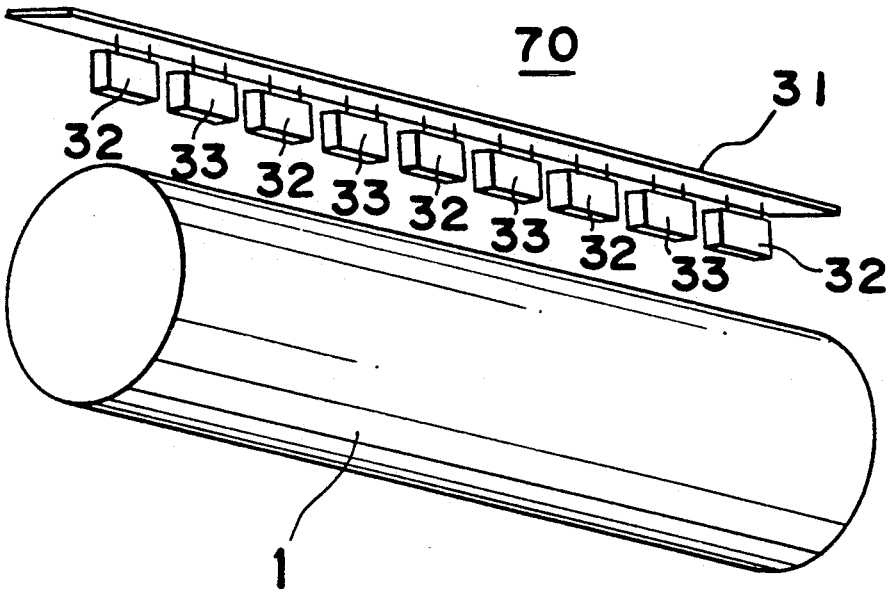
FIG. 13 is a perspective view showing the erasing device and the photosensitive member employed in the laser printer of FIG. 12.

FIG. 12 shows a laser printer K' to which an erasing device 70 according to a second embodiment of the present invention is applied. A humidity sensor unit 8 is provided between the cleaning device 6 and the erasing device 70. Meanwhile, in the erasing device 70, the red and green light emitting diodes 32 and 33 are alternately arranged in a line on the holder 31 as shown in FIG. 13. The number and an interval of the red and light emitting diodes 32 and 33 are determined based on an axial length of the photosensitive drum 1, an angle of expansion of directivity of the red and green light emitting diodes 32 and 33, a distance between the surface of the photosensitive drum 1 and the red and green light emitting diodes 32 and 33, etc. In the erasing device 70, the red light emitting diodes 32 have a peak wavelength of 660 nm, while the green light emitting diodes 33 have a peak wavelength of 560 nm. Since other constructions of the laser printer K' are the same as those of the laser printer K, description thereof is abbreviated for the sake of brevity.

Figure 14:
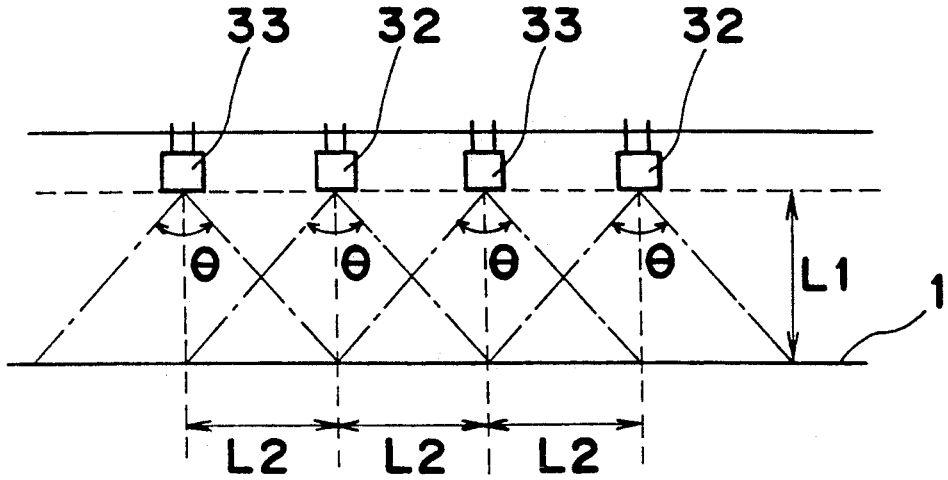
FIG. 14 is a view explanatory of arrangement of light emitting diodes employed in the erasing device of FIG. 12.

In this embodiment, in order to erase residual charge on the surface of the photosensitive drum 1, not only the red light emitting diodes 32 are turned on at a constant irradiance but the green light emitting diodes 33 are turned on at a variable irradiance including zero in accordance with environmental conditions of the photosensitive drum 1, especially change of absolute humidity as is described in detail below. For charge erasing, light from the red and green light emitting diodes 32 and 33 is required to be uniformly irradiated over the surface of the photosensitive drum 1. In this connection, the interval between the neighboring red and green light emitting diodes 32 and 33 plays a quite vital role. As shown in FIG. 14, supposing that character $\theta$ denotes an angle of expansion of directivity of the light emitting diodes 32 and 33, character L1 denotes a distance from a light emitting vertex (light emitting point closest to the photosensitive drum 1, i.e. center of the light emitting face in this embodiment) to the surface of the photosensitive drum 1 and character L2 denotes a distance between the light emitting vertexes of the neighboring red and green light emitting diodes 32 and 33, the following relation should be satisfied.

$$\tan(\theta/2) \geqq L2/L1$$

In this embodiment, the angle $\theta$ is 60°, the distance L1 is 20 mm and the distance L2 is 10 mm. Regarding directivity of the red and green light emitting diodes 32 and 33, it is desirable that the angle $\theta$ of the red and green light emitting diodes 32 and 33 should be as large as possible for the purpose of preventing such a phenomenon that quantity of light is scattered nonuniformly in the axial direction of the photosensitive drum 1.

Figure 15:
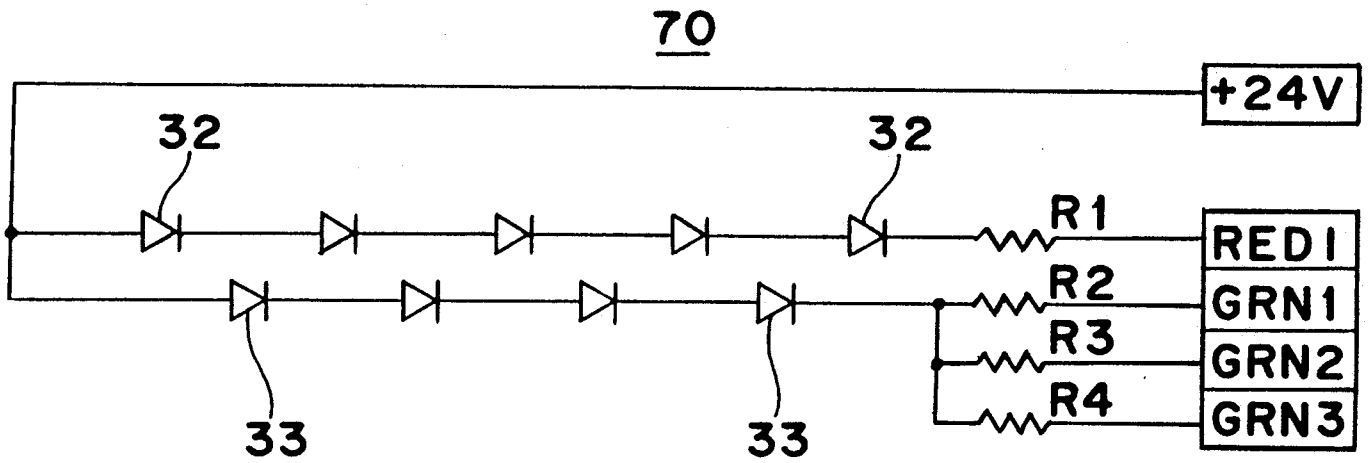
FIG. 15 is a circuit diagram of the erasing device of FIG. 12.

FIG. 15 shows a circuit of the erasing device 70. The light emitting diodes 32 are connected to each other in series and the light emitting diodes 33 are also connected to each other in series. On the other hand, the light emitting diodes 32 are connected to the light emitting diodes 33 in parallel. One end of the light emitting diodes 32 and 33 is connected to a power source of +24 V. Meanwhile, the other end of the light emitting diodes 32 is connected to a grounded terminal RED1 through a resistor R1. The other end of the light emitting diodes 33 is connected, via resistors R2, R3 and R4, to grounded terminals GRN1, GRN2 and GRN3, respectively. These terminals RED1 and GRN1-GRN3 can be turned on and off. When the terminal RED1 is turned on, the red light emitting diodes 32 are turned on at a constant quantity of light. Meanwhile, when some of the terminals GRN1-GRN3 in an arbitrary combination are turned on, the green light emitting diodes 33 are turned on at a quantity of light based on a resistance value of corresponding ones of the resistors R2-R4 for the energized ones of the terminals GRN1-GRN3.

Figure 16:
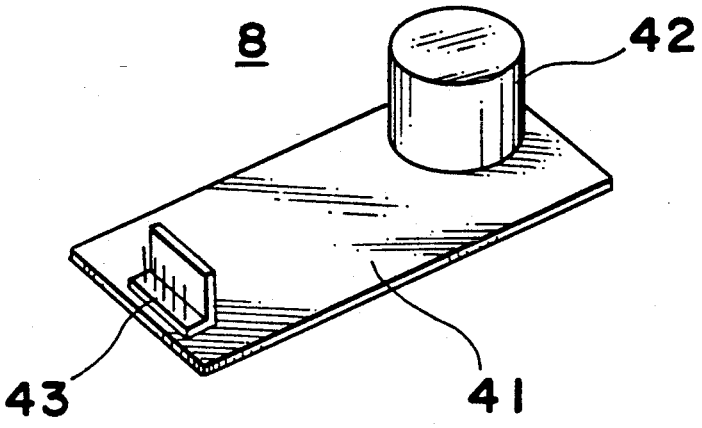
FIG. 16 is a perspective view of a humidity sensor unit employed in the laser printer of FIG. 12.
Figure 17:
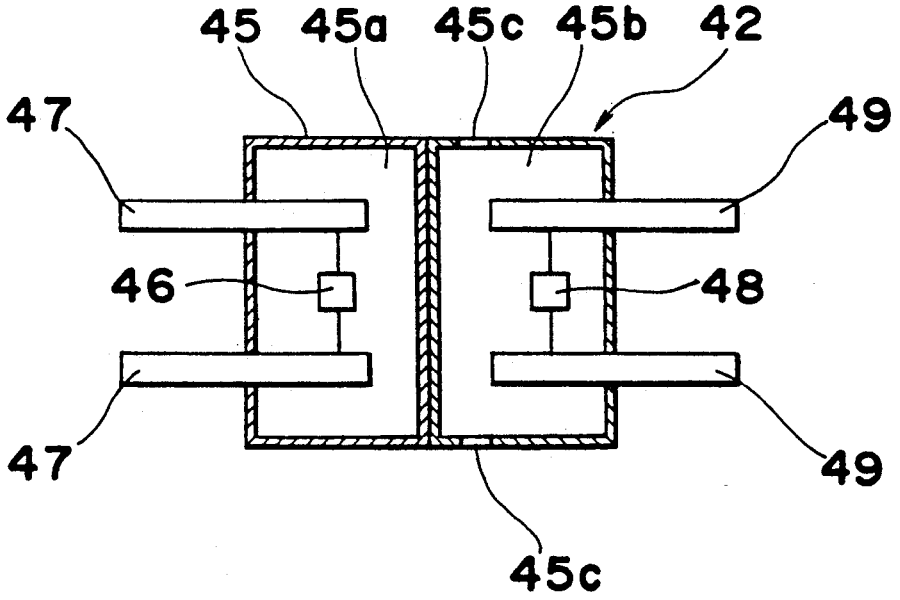
FIG. 17 is a horizontal sectional view of a humidity sensor of the humidity sensor unit of FIG. 16.

The humidity sensor unit 8 is provided around the photosensitive drum 1 so as to be disposed adjacent to the erasing device 70. In the humidity sensor unit 8, a sensor 42, a connector 43 and a detection circuit (not shown) are provided on a substrate 41 as shown in FIG. 16. As shown in FIG. 17, the sensor 42 includes a casing 45 having chambers **45*a* and 45*b*. A thermistor 46 having a pair of lead wires 47 is accommodated in the chamber 45*a*, while a thermistor 48 having a pair of lead wires 49 is accommodated in the chamber 45*b*. Dried air is contained in the chamber 45*a* hermetically, while the chamber 45*b* is communicated with atmosphere through a pair of ventilation holes 45*c*. Therefore, by comparing outputs of the thermistors 46 and 48**, it becomes possible to detect absolute humidity (g/m³).

Figure 18:
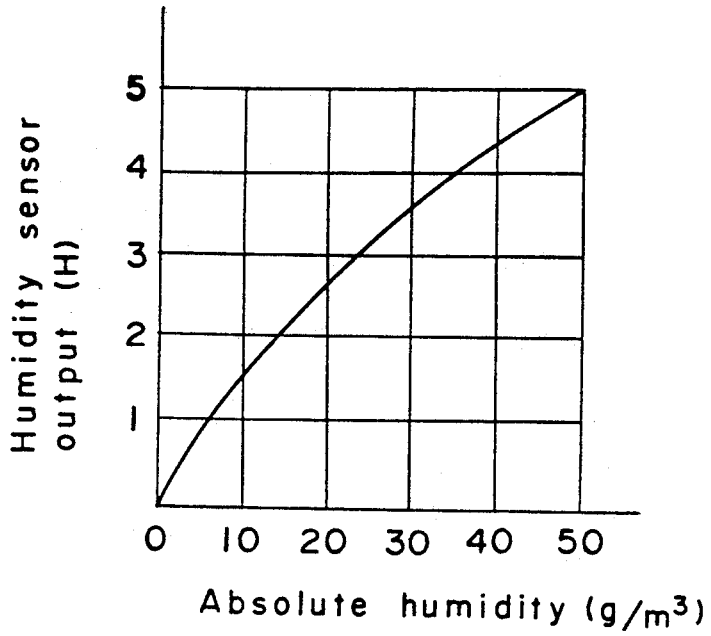
FIG. 18 is a graph showing relation between absolute humidity and output of the humidity sensor unit of FIG. 16.

FIG. 18 shows relation between output H from the humidity sensor unit 8 and absolute humidity.

Figure 19:
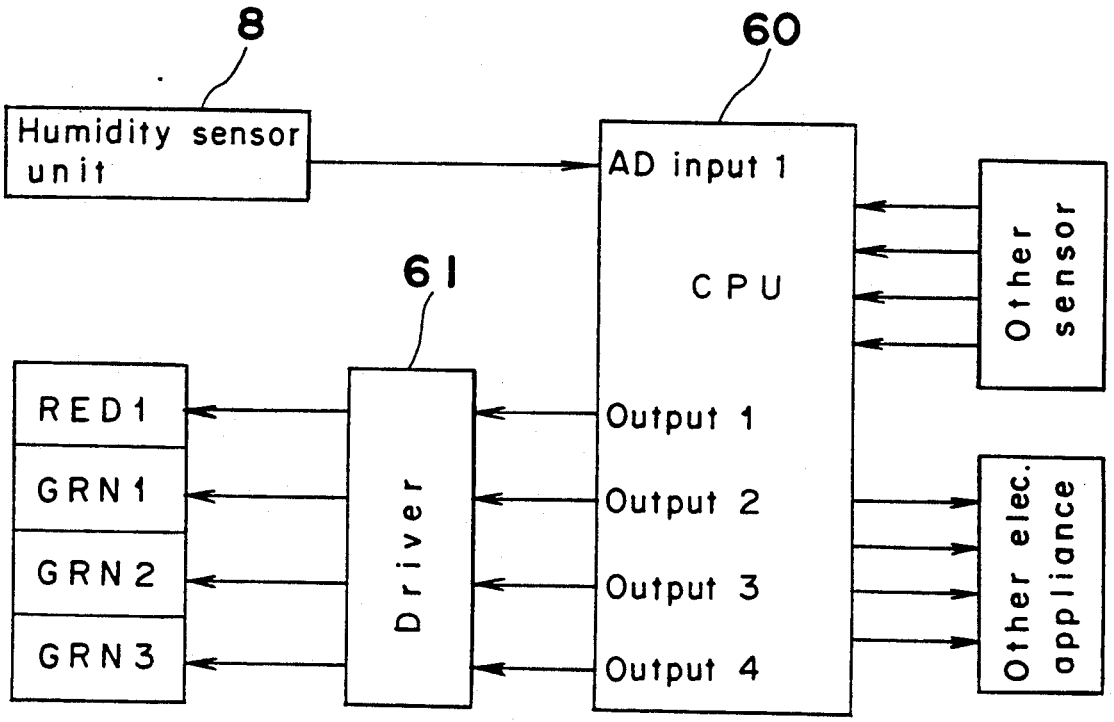
FIG. 19 is a block diagram showing a control circuit of the laser printer of FIG. 12.

FIG. 19 shows a control circuit of the laser printer K'. A single chip type microcomputer 60 includes a ROM, a RAM, an I/O interface, an A/D converter, etc. The output H from the humidity sensor unit 8 is applied to an AD input port 1 and outputs for turning on and off the terminals RED1, GRN1, GRN2 and GRN3 are generated from outputs 1, 2, 3 and 4, respectively so as to be applied to a driver 61.

Figure 20:
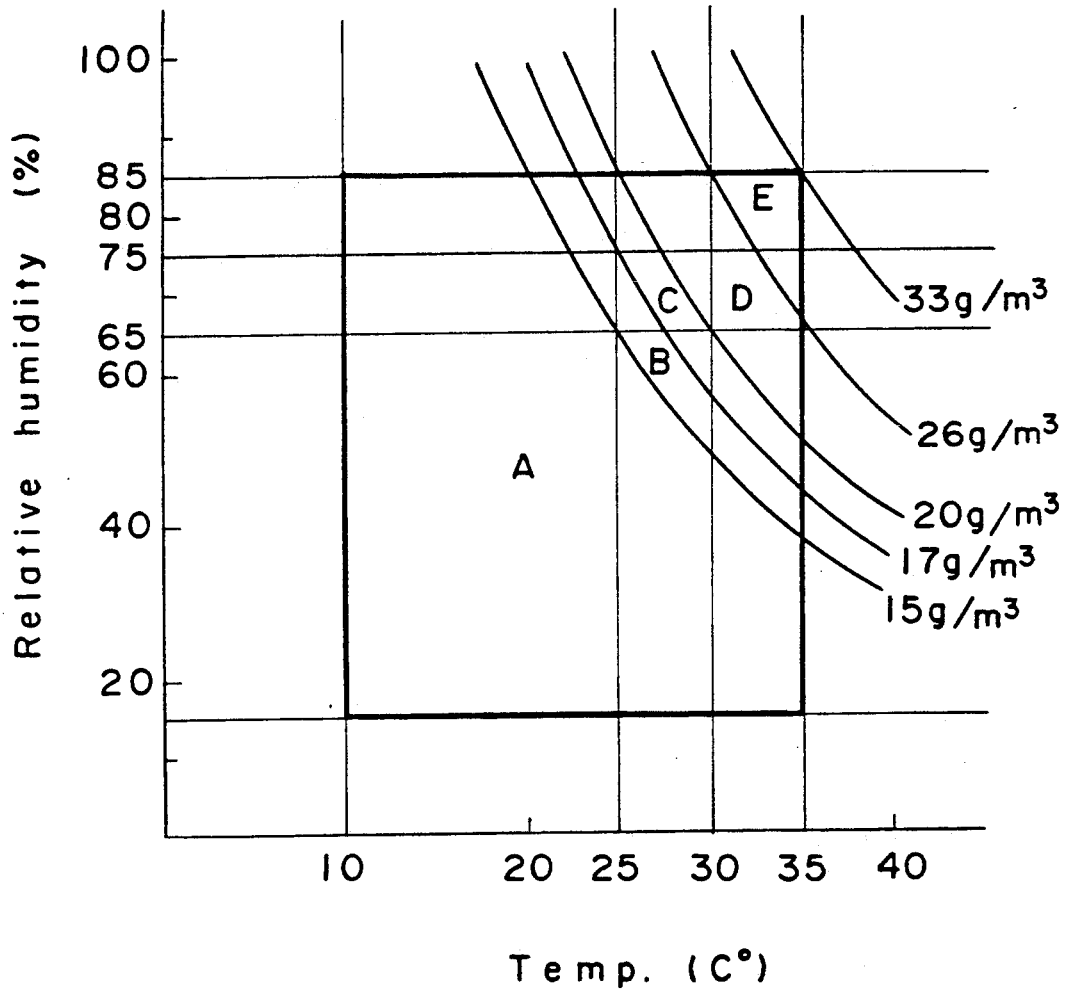
FIG. 20 is a graph showing regions of environmental conditions under which the erasing device of FIG. 12 should be controlled.
Figure 21:
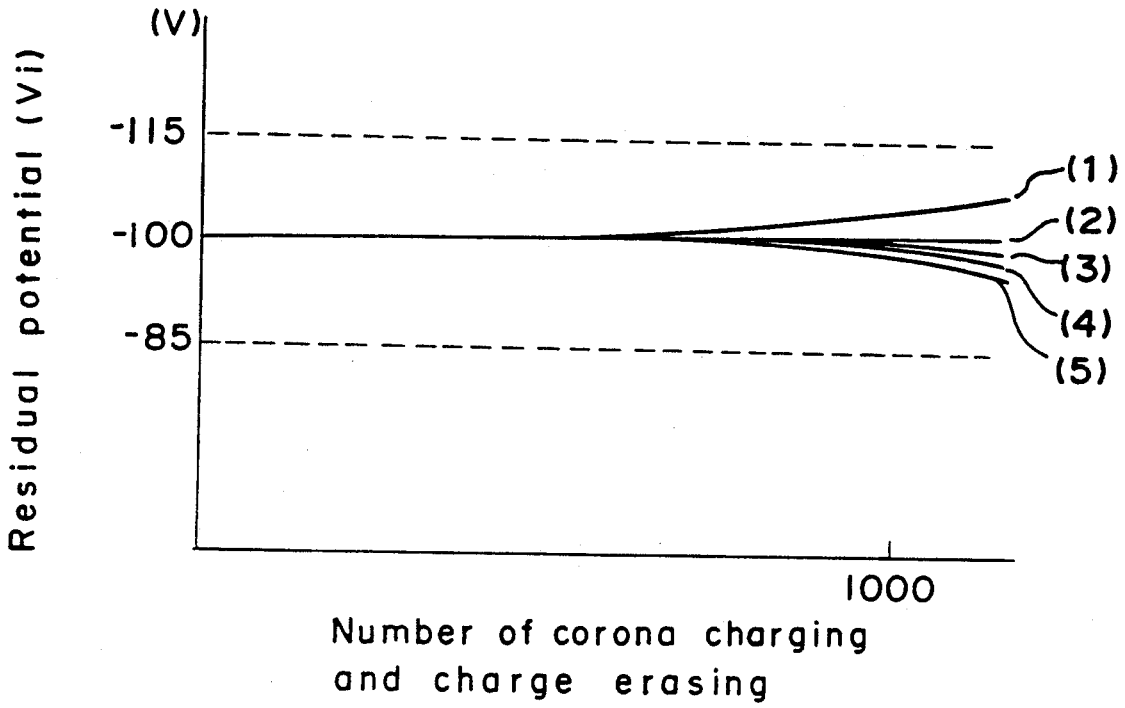
FIGS. 21 to 25 are graphs showing change of residual potential on the photosensitive member of FIG. 12 subjected to corona charging and charge erasing repeatedly.
Figure 22:
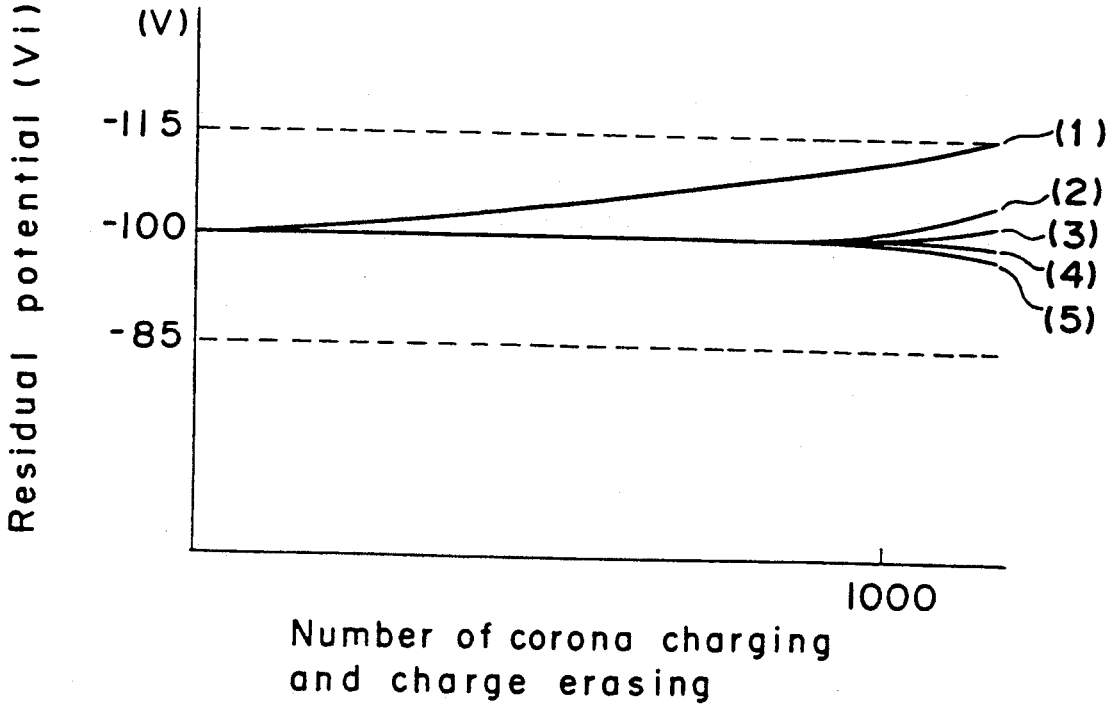
Figure 23:
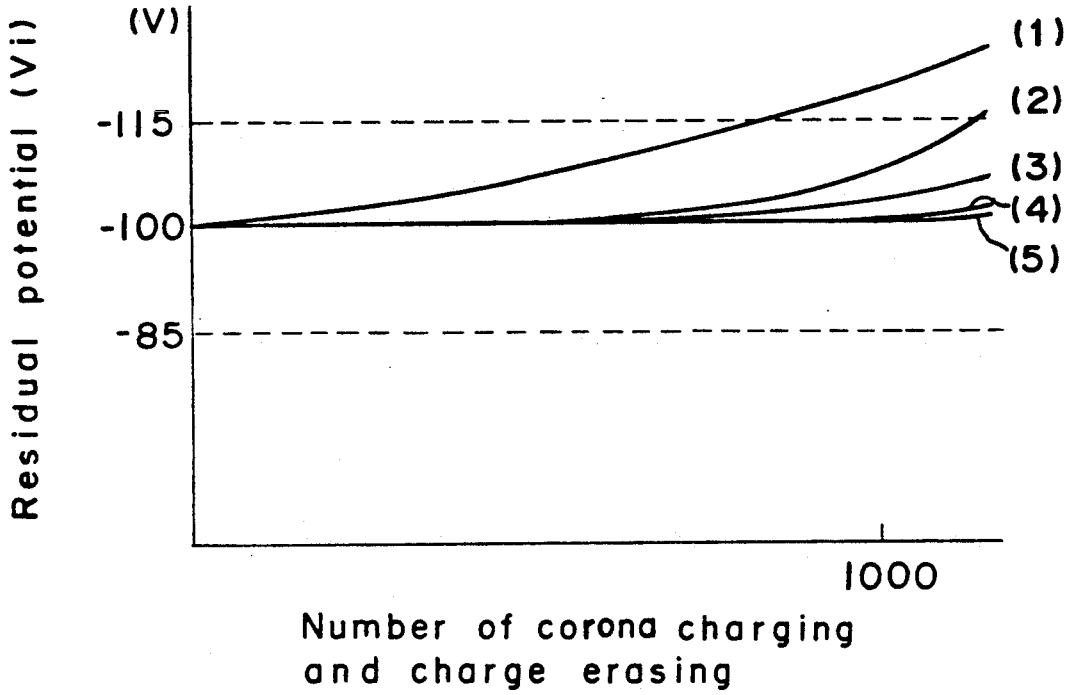
Figure 24:
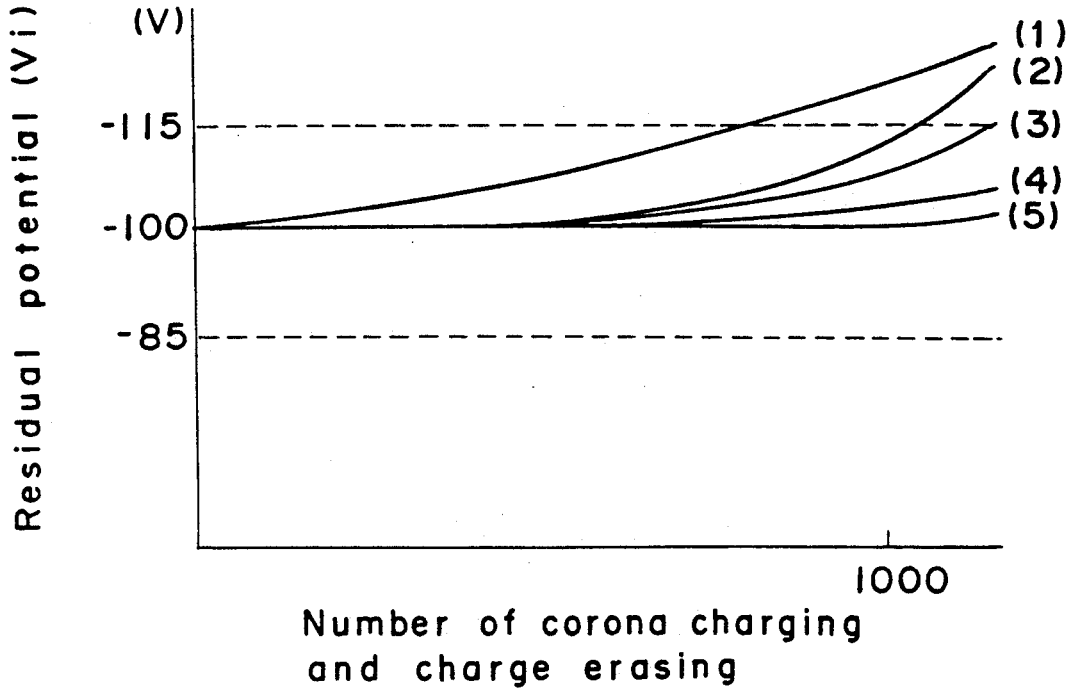
Figure 25:
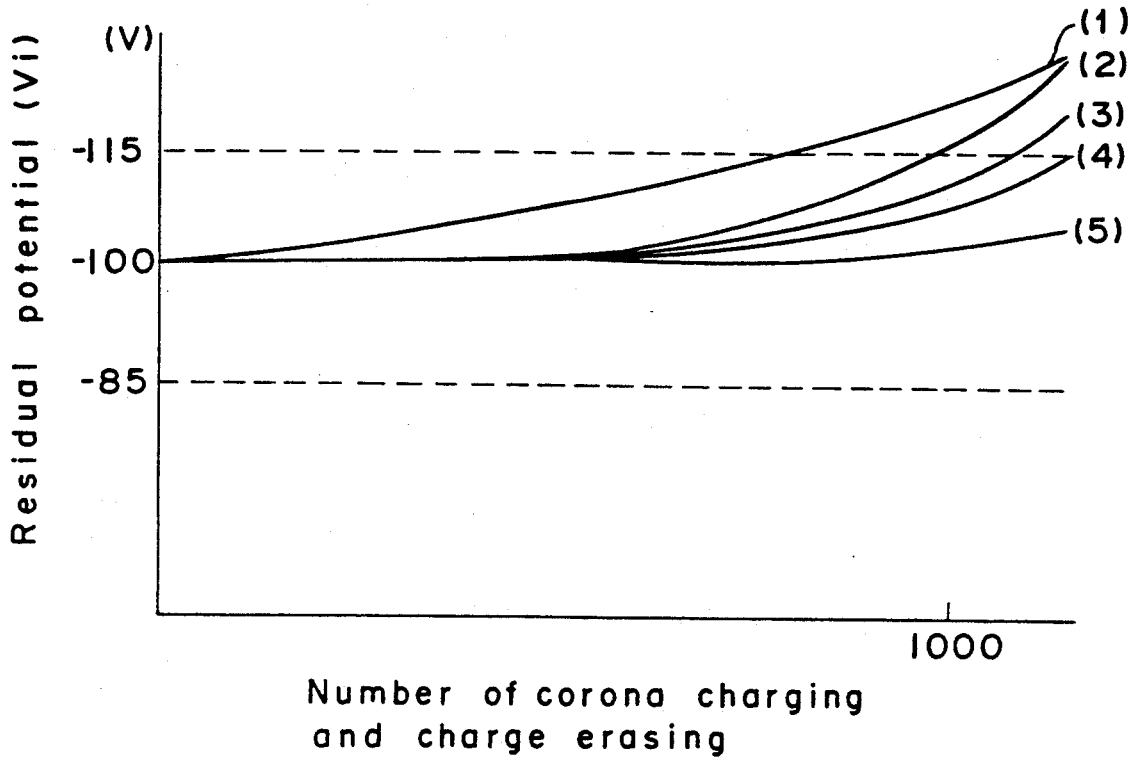

Meanwhile, as shown in FIG. 20, charge erasing effects can be divided into five regions A, B, C, D and E by curves of absolute humidity according to change of environmental conditions of the organic photosensitive surface layer. The laser printer K' is usually used in environment having a temperature of 10°-35° C. and a relative humidity of 15-85%, which occupies a rectangular area enclosed by thick straight lines in FIG. 20. In this embodiment, irradiances of the red and light emitting diodes 32 and 33 are, respectively, set in accordance with absolute humidity detected by the humidity sensor unit 8 as shown in Table 1 below.

TABLE 1

| Region | Absolute humidity (g/m³) | Irradiance (μW/cm²) Red LED | Green LED | Terminal |
|---|---|---|---|---|
| A | 0-15 | 100 | 0 | RED1 ON<br>GRN1 OFF<br>GRN2 OFF<br>GRN3 OFF |
| B | 15-17 | 100 | 10 | RED1 ON<br>GRN1 OFF<br>GRN2 OFF<br>GRN3 ON |
| C | 17-20 | 100 | 20 | RED1 ON<br>GRN1 OFF<br>GRN2 ON<br>GRN3 OFF |
| D | 20-26 | 100 | 30 | RED1 ON<br>GRN1 OFF<br>GRN2 ON<br>GRN3 ON |
| E | 26-33 | 100 | 35 | RED1 ON<br>GRN1 ON<br>GRN2 OFF<br>GRN3 OFF |

Namely, in this embodiment, irradiance of the red light emitting diodes 32 is made constant, while irradiance of the green light emitting diodes 33 is changed in accordance with absolute humidity as shown in Table 1. Change of irradiance of the green light emitting diodes 33 is controlled by properly combining ON and OFF states of the terminals GRN1-GRN3.

FIGS. 21 to 25 show change of the residual potential Vi obtained in the regions A to E, respectively after repetition of corona charging and charge erasing by turning on the light emitting diodes 32 and 33 at the irradiances shown in Table 1. Meanwhile, in FIGS. 21 to 25, the red light emitting diodes 32 have an irradiance of 100 μW/cm² in all curves (1) to (5). On the other hand, irradiance of the green light emitting diodes 33 is 0 μW/cm² in the curve (1), 10 μW/cm² in the curve (2), 20 μW/cm² in the curve (3), 30 μW/cm² in the curve (4) and 35 μW/cm² in the curve (5). As is apparent from FIGS. 21 to 25, even if corona charging and charge erasing are repeated 1,000 times in the regions A to E, the residual potential Vi does not rise so much and falls within an effective permissible range. This may be because holes trapped in the charge transporting layer of the organic photosensitive surface layer are released from trap by light from the green light emitting diodes 33 having a peak wavelength of 560 nm so as to cancel charge of negative polarity on the surface of the charge transporting layer.

Meanwhile, excessive irradiation of light from the green light emitting diodes 33 results in partial rise of temperature of the photosensitive drum 1 and thus, a nonuniform image is formed as described above. Therefore, irradiation of light from the green light emitting diodes 33 is so minimized as to fall within the effective permissible range.

Figure 26:
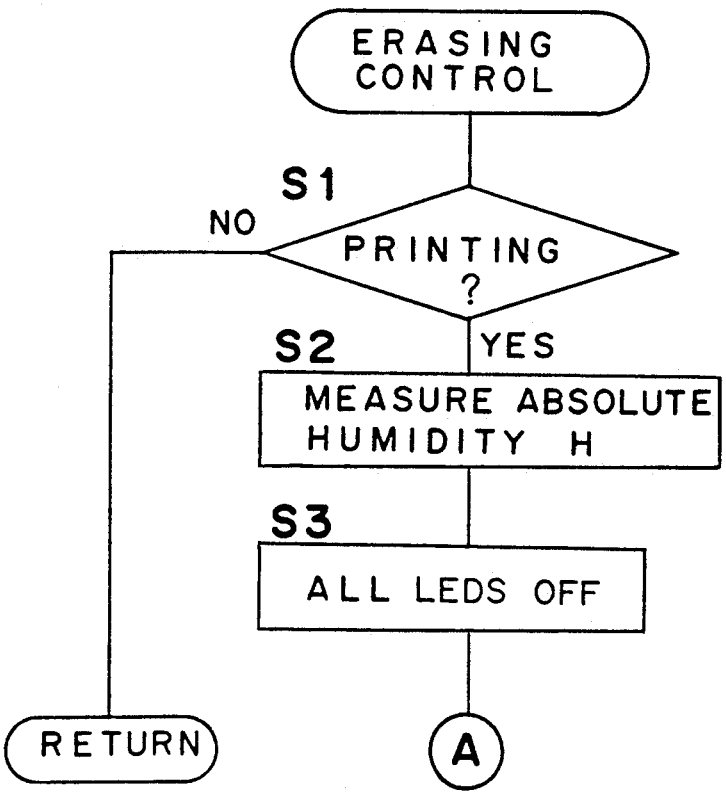
FIGS. 26 and 27 are flow charts showing control sequences of charge erasing of the erasing device of FIG. 12.
Figure 27:
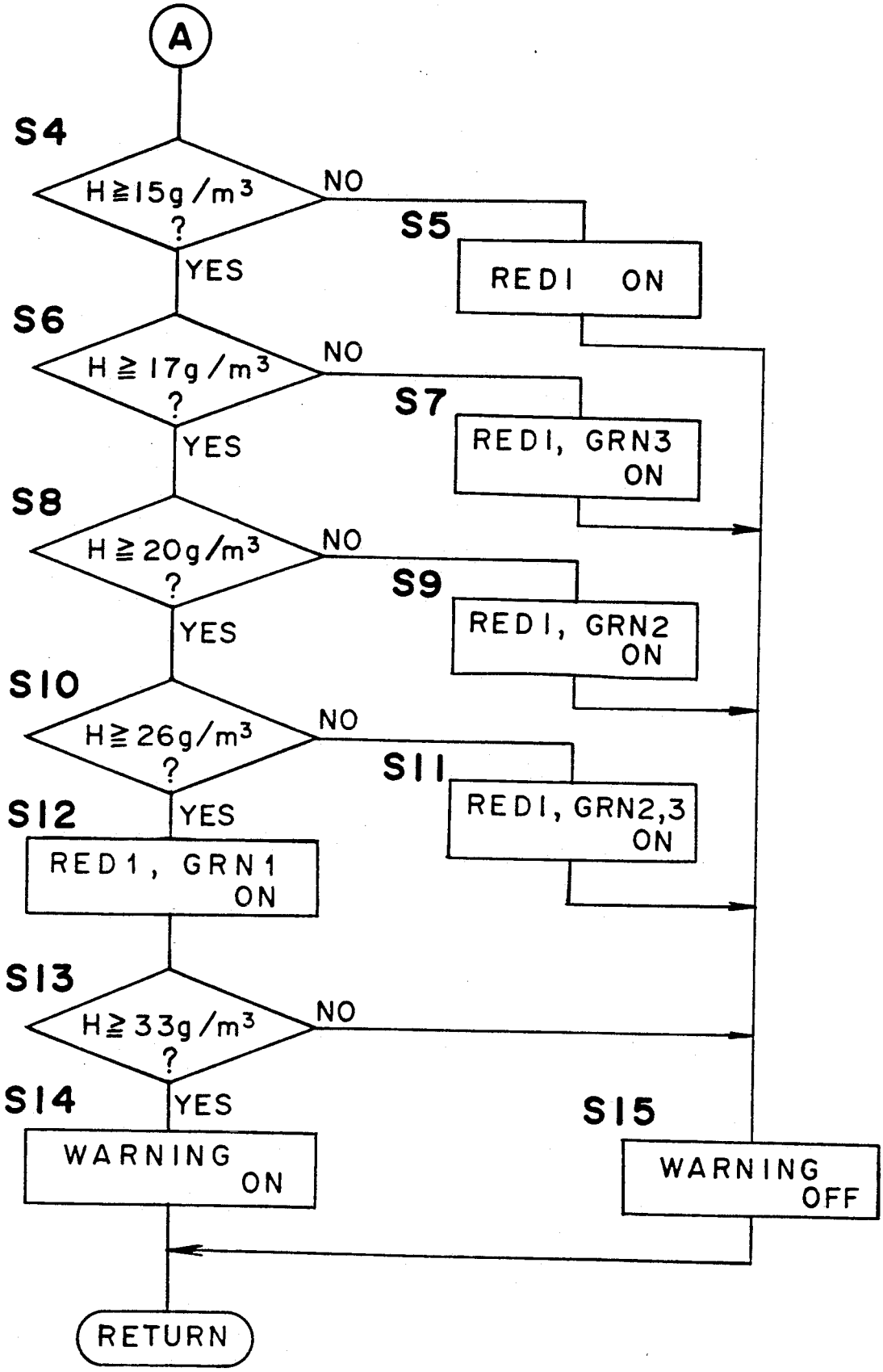

Hereinbelow, control sequences of charge erasing of the erasing device 70 are described with reference to flow charts of FIGS. 26 and 27. When subroutines of FIGS. 26 and 27 for controlling charge erasing are called, it is initially judged at step S1 whether or not the laser printer K' is printing. In the case of "NO" at step S1, this subroutine is immediately terminated and the processing sequence returns to a main routine (not shown). On the contrary, in the case of "YES" at step S1, absolute humidity H is measured by the humidity sensor unit 8 at step S2 and all the light emitting diodes 32 and 33 are turned off temporarily at step S3. Then, at steps S4, S6, S8 and S10, it is decided to which one of the regions A to E current environmental conditions belong. On the basis of this decision, the terminals RED1 and GRN1–GRN3 are turned on and off and irradiances of the light emitting diodes 32 and 33 are controlled to values shown in Table 1. Namely, in the case of "NO" at step S4, the environmental conditions belong to the region A and thus, only the terminal RED1 is turned on at step S5. In the case of "NO" at step S6, the environmental conditions belong to the region B and thus, the terminals RED1 and GRN3 are turned on at step S7. Meanwhile, in the case of "NO" at step 8, the environmental conditions belong to the region C and thus, the terminals RED1 and GRN2 are turned on at step S9. In the case of "NO" at step S10, the environmental conditions belong to the region D and thus, the terminals RED1, GRN2 and GRN3 are turned on at step S11. On the other hand, in the case of "YES" at step S10, the environmental conditions belong to the region E and thus, the terminals RED1 and GRN1 are turned on at step S12. Subsequently, at step S13, it is judged whether or not the absolute humidity H is 33 g/m$^3$ or more. In the case of "NO" at step S13, ON and OFF states of the terminals set at step S12 are maintained. On the other hand, in the case of "YES" at step 13, the environmental conditions fall out of normal environmental conditions for operating the laser printer K' and thus, a warning is displayed on an operating panel (not shown) at step S14 and the processing sequence returns to the main routine. Meanwhile, after ON states of the light emitting diodes 32 and 33 corresponding to the regions A to E have been set, the warning display is turned off at step S15 and the processing sequence returns to the main routine.

As will be seen from the foregoing description, in the second embodiment of the present invention, a plurality of the light sources are turned on at optimum light emitting conditions based on detected environmental conditions of the photosensitive member. Therefore, in accordance with the second embodiment of the present invention, residual potential after charge erasing can be restricted to the predetermined permissible range in accordance with change of environmental conditions of the photosensitive member, so that a high-quality image can be obtained at all times.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An erasing device for erasing charge remaining on an organic photosensitive member, comprising:

two kinds of light sources which are so provided as to confront said photosensitive member and have different light emitting wavelengths, respectively;

a control means for turning on said light sources simultaneously;

a measuring means for measuring humidity around the device; and an adjusting means for adjusting a light emitting state of at least one kind of said light source on the basis of the humidity.

2. An erasing device as claimed in claim 1, wherein said adjusting means adjusts quantity of light emitted by the one kind of said light source, the one kind of said light source having a wavelength shorter than the other kind of said light source.

3. An erasing device for erasing charge remaining on an organic photosensitive member, comprising:

two kinds of light sources which are so provided as to confront said photosensitive member and have different light emitting wavelengths, respectively;

a control means for turning on said light sources simultaneously;

wherein said light sources are alternately arranged in a line so as to satisfy the following relation:

$$\tan(\theta/2) \geqq L2/L1$$

where character $\theta$ denotes an angle of expansion of light emitted by each of said light sources, character L1 denotes a distance between a light emitting vertex of each of said light sources and a surface of said photosensitive member and character L2 denotes a distance between the light emitting vertexes of neighboring ones of said light sources.

4. An image forming apparatus comprising:

an organic photosensitive member;

a charging means for charging said photosensitive member;

an exposure means for partially erasing charge on said photosensitive member such that an electrostatic latent image is formed on said photosensitive member;

a developing device for developing the electrostatic latent image on said photosensitive member into a toner image;

a transfer means for transferring the toner image on said photosensitive member onto an image support member;

an erasing means for erasing charge remaining on said photosensitive member, which is located downstream of said transfer means in a direction of displacement of said photosensitive member, said erasing means including at least two kinds of light sources having different light emitting wavelengths, respectively, wherein one kind of said light source has a peak wavelength of about 600 to 800 nm, while the other kind of said light source has a peak wavelength of about 500 to 600 nm;

a measuring means for measuring a humidity condition; and an adjusting means for adjusting a light emitting state of at least one kind of said light source on the basis of the humidity.

5. An image forming apparatus as claimed in claim 4, wherein each of said light sources is constituted from a plurality of light emitting devices and the plurality of light emitting devices are alternately arranged in a line so as to satisfy the following relation:

$$\tan(\theta/2) \geqq L2/L1$$

where character $\theta$ denotes an angle of expansion of light emitted by each of said first and second light emitting devices, character L1 denotes a distance between a light emitting vertex of each of said first and second light emitting devices and a surface of said photosensitive member and character L2 denotes a distance between the light emitting vertexes of neighboring ones of said first and second light emitting devices.

6. An image forming apparatus comprising:

an organic photosensitive member;

a charging means for charging said photosensitive member;

a developing device for developing the electrostatic latent image on said photosensitive member into a toner image;

a transfer means for transferring the toner image on said photosensitive member onto an image support member; and an erasing means for erasing charge remaining on said photosensitive member, which is located downstream of said transfer means in a direction of displacement of said photosensitive member, said erasing means including at least two kinds of light sources having different light emitting wavelengths, respectively, wherein one kind of said light source has a peak wavelength of about 600 to 800 nm, while the other kind of said light source has a peak wavelength of about 500 to 600 nm;

wherein each of said light sources is constituted from a plurality of light emitting devices and these devices are alternately arranged in a line so as to satisfy the following relation:

$$\tan(\theta/2) \geqq L2/L1$$

where character $\theta$ denotes an angle of expansion of light emitted by each of said first and second light emitting devices, character L1 denotes a distance between a light emitting vertex of each of said first and second light emitting devices and a surface of said photosensitive member and character L2 denotes a distance between the light emitting vertexes of neighboring ones of said first and second light emitting devices.

7. An image forming apparatus as claimed in claim 6, wherein said first and second light sources are first and second light emitting diodes, respectively.

8. An image forming apparatus comprising:

an organic photosensitive member;

a charging means for charging said photosensitive member;

an exposure means for partially erasing charge on said photosensitive member such that an electrostatic latent image is formed on said photosensitive member;

a developing device for developing the electrostatic latent image on said photosensitive member into a toner image;

a transfer means for transferring the toner image on said photosensitive member onto an image support member;

an erasing means for erasing charge remaining on said photosensitive member, which includes at least two kinds of light sources having different light emitting wavelengths, respectively;

a measuring means for measuring humidity; and an adjusting means for adjusting a light emitting state of at least one kind of said light source on the basis of the humidity.

9. An image forming apparatus as claimed in claim 8, wherein said light sources are constituted by one kind of a plurality of first light emitting diodes and another kind of a plurality of second light emitting diodes such that said first and second light emitting diodes are arranged linearly.

10. An image forming apparatus as claimed in claim 9, wherein said first and second light emitting diodes are alternately arranged in a line so as to satisfy the following relation:

$$\tan(\theta/2) \geqq L2/L1$$

where character $\theta$ denotes an angle of expansion of light emitted by each of said first and second light emitting diodes, character L1 denotes a distance between a light emitting vertex of each of said first and second light emitting diodes and a surface of said photosensitive member and character L2 denotes a distance between the light emitting vertexes of neighboring ones of said first and second light emitting diodes.

11. An image forming apparatus as claimed in claim 8, wherein in response to rise of the humidity, said adjusting means increases intensity of light emitted by the one kind of said light source.

12. An image forming apparatus as claimed in claim 11, wherein the one kind of said light source has a wavelength shorter than another kind of said light source.

* * * * *